US009357327B2

(12) United States Patent
Van Dongen et al.

(10) Patent No.: US 9,357,327 B2
(45) Date of Patent: May 31, 2016

(54) LOUDSPEAKER SYSTEM FOR REPRODUCING MULTI-CHANNEL SOUND WITH AN IMPROVED SOUND IMAGE

(75) Inventors: Charlie Corneles Van Dongen, Frankston (AU); David James Still Alexandrou, Caulfield North (AU); Lindsay Alfred Champion, Vermont (AU)

(73) Assignee: Reality IP Pty Ltd, Caulfield (AU)

( * ) Notice: Subject to any disclaimer, the term of this patent is extended or adjusted under 35 U.S.C. 154(b) by 992 days.

(21) Appl. No.: 13/379,083

(22) PCT Filed: Aug. 20, 2010

(86) PCT No.: PCT/AU2010/001073

§ 371 (c)(1), (2), (4) Date: Mar. 9, 2012

(87) PCT Pub. No.: WO2011/020157

PCT Pub. Date: Feb. 24, 2011

(65) Prior Publication Data

US 2012/0155679 A1 Jun. 21, 2012

(30) Foreign Application Priority Data

Aug. 21, 2009 (AU) ..... 2009903981
Nov. 13, 2009 (AU) ..... 2009905586

(51) Int. Cl.
*H04R 5/02* (2006.01)
*H04S 7/00* (2006.01)
(Continued)

(52) U.S. Cl.
CPC ..... *H04S 7/302* (2013.01); *H04R 1/403* (2013.01); *H04R 27/00* (2013.01); *H04S 3/00* (2013.01); *H04S 2420/01* (2013.01); *H04S 2420/05* (2013.01)

(58) Field of Classification Search
CPC . H04S 7/302; H04S 2420/05; H04S 2420/01; H04S 3/00; H04R 1/403; H04R 27/00
USPC ..... 381/304, 303, 17, 92, 333, 58, 59, 18, 381/310, 307, 300
See application file for complete search history.

(56) References Cited

U.S. PATENT DOCUMENTS 5,809,150 A * 9/1998 Eberbach ..... 381/300
6,731,765 B1 5/2004 Sotome
(Continued)

FOREIGN PATENT DOCUMENTS

CN 1883228 12/2006
JP H02-113493 4/1990
(Continued)

*Primary Examiner* — Paul S Kim

(57) ABSTRACT

A loudspeaker system for reproducing multichannel sound with an improved sound image in a listening zone is disclosed. The loudspeaker system includes a first speaker array for location in a first position relative to the listening zone and a second speaker array for location in a second position relative to the listening zone. The first speaker array includes a first radiating lobe for radiating first sound of the multichannel sound and at least a second radiating lobe for radiating a delayed version of the first sound. The second speaker array includes a first radiating lobe for radiating second sound of the multichannel sound, and at least a second radiating lobe for radiating a delayed version of the second sound. The loudspeaker system includes means for modifying the radiating or polar pattern associated with each radiating lobe; wherein the system is arranged such that a listening position substantially equidistant from the first and second arrays is exposed to radiation from the second lobes or from the first lobes and a listening position not substantially equidistant from the first and second arrays is exposed to radiation from both the first lobe of one array and the second lobe of the other array such that substantially all positions in the listening zone receive sound radiation from the first and second arrays with substantially equal arrival times.

42 Claims, 9 Drawing Sheets

(51) Int. Cl.

| | |
|---|---|
| *H04R 1/40* | (2006.01) |
| *H04R 27/00* | (2006.01) |
| *H04S 3/00* | (2006.01) |

(56) References Cited

U.S. PATENT DOCUMENTS

| | | | | |
|---|---|---|---|---|
| 2007/0110268 | A1* | 5/2007 | Konagai et al. | 381/335 |
| 2009/0129602 | A1 | 5/2009 | Konagai et al. | |

FOREIGN PATENT DOCUMENTS

| | | |
|---|---|---|
| JP | H10-108292 | 4/1998 |
| JP | 2006-352732 | 12/2006 |
| JP | 2007-074336 | 3/2007 |
| JP | 2007-274361 | 10/2007 |
| JP | 2008-098826 | 4/2008 |
| JP | 2008-529364 | 7/2008 |
| WO | 2006/079086 | 7/2006 |

* cited by examiner

LOUDSPEAKER SYSTEM FOR REPRODUCING MULTI-CHANNEL SOUND WITH AN IMPROVED SOUND IMAGE

FIELD OF THE INVENTION

The present invention relates to a loudspeaker system for reproducing multi-channel sound with an improved sound image. In some embodiments a loudspeaker system according to the present invention may be suitable for use in a listening zone which serves as a home theatre. In further embodiments the loudspeaker system may be suitable for use in relatively larger auditoriums such as commercial theatres or cinemas.

BACKGROUND OF THE INVENTION

Multi-channel sound, defined herein as sound reproduced from more than two audio channels, for example, 5.1 or 7.1 channels including 5 or more mid to high frequency channels and a sub-woofer channel is typically reproduced through multiple speakers positioned in front, rear and possibly sides of a listening zone. Multi-channel sound may provide added freedom to recreate an immersive or surround sound listening experience. However, such systems tend to be expensive and complex to install, particularly for smaller installations such as home theatres. Additionally, an acceptable immersive or surround sound listening experience is typically limited to a relatively small listening area located near the centre of the listening zone. Accordingly it would be desirable if a system could be devised that provides fewer loudspeakers yet provides an acceptable surround sound experience for substantially all positions in a listening zone and particularly for multi-channel sound including simulated surround sound.

Various techniques exist to mix multi-channel sound into a two channel format. Some techniques combine all signals into a two-channel format while adjusting only relative gains of the mixed signals. Other techniques include application to an audio signal of frequency shaping, amplitude adjustments and/or phase shifts or a combination of the above during a mixing process. The technique or techniques used may depend on the format and content of the audio signals as well as the intended use of any final two channel mix.

The techniques found in the prior art, including those found in professional recording applications do not provide an effective method for reproducing multi-channel signals in a two channel format that achieves realistic audio reproduction through a limited number of discrete channels. As a result, much ambience information which is responsible for providing an immersive perception of sound may be lost or masked. Despite prior art attempts at reproducing multi-channel sound to achieve a realistic experience in a listening zone through a limited number of channels, there remains much room for improvement.

The present invention may provide a loudspeaker system for reproducing in a listening zone multi-channel sound in a two channel or other limited channel format with an improved sound image, such that substantially all positions throughout the listening zone may perceive sound arriving from each channel with substantially equal arrival times.

SUMMARY OF THE INVENTION

According to one aspect of the present invention there is provided a loudspeaker system for reproducing multichannel sound with an improved sound image in a listening zone, said loudspeaker system including:

a first speaker array for location in a first position relative to said listening zone;

a second speaker array for location in a second position relative to said listening zone;

said first speaker array including a first radiating lobe for radiating first sound of said multichannel sound and at least a second radiating lobe for radiating a delayed version of said first sound;

said second speaker array including a first radiating lobe for radiating second sound of said multichannel sound, and at least a second radiating lobe for radiating a delayed version of said second sound; and means for modifying the radiating or polar pattern associated with each radiating lobe;

wherein said system is arranged such that a listening position substantially equidistant from said first and second arrays is exposed to radiation from said second lobes or from said first lobes and a listening position not substantially equidistant from said first and second arrays is exposed to radiation from both said first lobe of one array and said second lobe of the other array such that substantially all positions in said listening zone receive sound radiation from said first and second arrays with substantially equal arrival times.

The first speaker array may be located in a left front position relative to the listening zone and the second speaker array may be located in a right front position relative to the listening zone.

In some embodiments the first speaker array may be located in a lower left position relative to the listening zone and the second speaker array may be located in an upper left position relative to the listening zone.

In some embodiments the first speaker array may be located in a lower right position relative to the listening zone and the second speaker array may be located in an upper right position relative to the listening zone.

Each speaker array may be associated with means for generating simulated surround sound from a program source such as two channel or stereo sound. Alternatively the program source may include multichannel sound that has been mixed or matrixed into two channel sound in any suitable manner or by any suitable means. The means for generating simulated surround sound may include sound reproduced via a head related transfer function (HRTF) filter.

One example of a system including a HRTF filter is disclosed in U.S. Pat. No. 5,438,623 issued to Begault. In Begault, individual audio signals are divided into two signals which are each delayed and filtered according to a head related transfer function (HRTF) for the left and right ears. The resultant signals are then recombined to generate left and right output signals intended for playback through a set of headphones.

Other examples of HRTF transfer functions which may be used to achieve a perceived azimuth are described in an article by E. A. B. Shaw entitled "Transformation of Sound Pressure Level From the Free Field to the Eardrum in the Horizontal Plane", J. Acoust. Soc. Am., Vol. 56, No. 6, December 1974, and in an article by S. Mehrgarat and V. Mellert entitled "Transformation Characteristics of the External Human Ear", J. Acoust. Soc. Am., Vol. 61, No. 6, June 1977, the disclosures of which are incorporated herein by cross-reference.

The means for modifying the radiating or polar pattern associated with each radiating lobe may include at least one acoustically opaque member. The acoustically opaque member may include a sound separating or reflecting flap which projects into the listening zone. Alternatively or additionally the means for modifying the radiation or polar pattern may include means for shaping an enclosure associated with each speaker array.

The first speaker array may include a third radiating lobe for radiating a further delayed version of the first sound and the second speaker array may include a third radiating lobe for radiating a further delayed version of the second sound. A loudspeaker system incorporating three or more radiating lobes in each array may be suitable for use in larger auditoriums such as public theatres and concert halls. The loudspeaker system may include means for adjusting sound pressure level associated with each radiating lobe.

According to a further aspect of the present invention there is provided a loudspeaker system for a listening zone in a room such as a home theatre, the listening zone including notional front and rear extremities and notional right and left sides in a plan representation, the loudspeaker system including:

first and second arrays of speakers, each array of speakers including discrete at least first and second sound radiating lobes;

wherein the first array of speakers is locatable at a left front position of the room whereby a line therefrom normal to the front or rear extremities generally defines the notional left side of the listening zone, such that the first sound radiating lobe of the first speaker array is directed towards a position within an area generally at the right side of the listening zone substantially midway between the front and rear extremities of the listening zone, and such that the second sound radiating lobe is directed towards a position within an area generally about one quarter of the distance between the right and left sides from the left side substantially midway between the front and rear extremities of the listening zone;

wherein the second array of speakers is locatable at a right front position of the room whereby a line therefrom normal to the front or rear extremities generally defines the notional right side of the listening zone such that the first sound radiating lobe of the second speaker array is directed towards a position within an area generally at the left side of the listening zone substantially midway between the front and rear extremities of the listening zone, and such that the second sound radiating lobe of the speaker array is directed towards a position within an area generally about one quarter of the distance between the right and left sides from the right side substantially midway between the front and rear extremities of the listening zone;

wherein a radiating or polar pattern associated with the first sound radiating lobe of the first speaker array is modified such that it is received at a lower sound pressure level in the listening zone in an area defined between a line from the first speaker array through a position generally about three quarters of the distance between the right and left sides from the right side substantially midway between the front and rear extremities of the listening zone and the right side of the listening zone, and wherein a radiating or polar pattern associated with the first radiating lobe of the second speaker array is modified such that it is received at a lower sound pressure level in the listening zone in an area defined between a line from the second speaker array through a position generally about three quarters of the distance between the left and right sides from the left side substantially midway between the front and rear extremities of the listening zone and the left side of the listening zone.

According to a still further aspect of the present invention there is provided a loudspeaker system for reproducing multichannel sound with an improved sound image in a listening zone, said loudspeaker system including:

a left speaker cluster for location in a left front position relative to said listening zone, said left speaker cluster including a first speaker array located in a lower left position relative to said listening zone and a second speaker array located in an upper left position relative to said listening zone;

a right speaker cluster for location in a right front position relative to said listening zone, said right speaker cluster including a third speaker array located in a lower right position relative to said listening zone and a fourth speaker array located in an upper right position relative to said listening zone;

each left speaker array including a first radiation lobe for radiating first sound of said multichannel sound and at least a second radiation lobe for radiating a delayed version of said first sound;

each right speaker array including a first radiation lobe for radiating second sound of said multichannel sound, and at least a second radiation lobe for radiating a delayed version of said second sound; and means for modifying the radiation or polar pattern associated with each radiation lobe;

wherein said system is arranged such that a listening position substantially equidistant from said left and right clusters is exposed to sound radiation from delayed radiation lobes or from non-delayed radiation lobes associated with said left or right clusters and a listening position not substantially equidistant from said left and right clusters is exposed to sound radiation from both delayed and non delayed radiation lobes associated with said left or right clusters, and a listening position substantially equidistant from said lower and upper speaker arrays is exposed to sound radiation from delayed radiation lobes or non delayed radiation lobes associated with said upper or lower arrays and a listening position not substantially equidistant from said lower and upper speaker arrays is exposed to sound radiation from both delayed and non delayed radiation lobes associated with said upper and lower arrays such that substantially all positions in said listening zone receive sound radiation from said arrays with substantially equal arrival times.

The radiating or polar pattern of the first sound radiation lobe of each speaker array may be modified in any suitable manner and by any suitable means associated with each array. The means for modifying the radiating or polar pattern may include at least one acoustically opaque member such as a sound separating or reflecting member. In one embodiment the sound separating or reflecting member may include a flap which projects into the room or listening zone from the or each speaker array. Alternatively or additionally the means for modifying the radiating or polar pattern may include means for shaping an enclosure associated with each speaker array.

In an embodiment which seeks to create a sound image in a listening zone such that listeners in all positions within the zone receive sound radiation from each array with substantially equal arrival times, each speaker array may be associated with amplifiers and time delay circuits. The amplifiers may be adjustable to provide gains such that sound pressure levels of sounds reaching a listener at any position in the listening zone from a first array such as a left speaker array may be substantially equal to sound pressure levels of sounds reaching the same listener from a second array such as a right speaker array. The time delay circuits associated with each speaker array may be adjustable to provide sound transmitted along at least one radiating lobe of an array that is time delayed relative to sound transmitted along at least one other radiating lobe of that array, such that coincident sounds directed towards the listener at any position in the listening zone from the first (eg. left) and second (eg. right) arrays of speakers may reach that listener with substantially equal arrival times.

The time delay (Td) for a not substantially equidistant listening position may be obtained by the expression Td=(Dn−Df)/v, wherein Dn is the distance from the not equidistant listening position to a nearer speaker array, Df is the distance from the not equidistant listening position to a further speaker array, and v is the speed of sound.

Each array of speakers may include at least two speakers, one of which may provide the first sound radiating lobe and the other of which may provide the second sound radiating lobe. In a system for a home theatre each array of speakers may include three speakers or three speaker panels, wherein an innermost speaker or panel of each array may provide the first sound radiating lobe and the two outermost speakers or panels of each array may provide in combination the second sound radiating lobe. Each speaker array may be associated with amplifiers and the two outermost speakers may be associated with signal delay circuits to provide a delay in sound transmission from the two outermost speakers or panels of each array.

In some embodiments the speakers or panels of each array may include a relatively narrow polar pattern at mid to high range frequencies. The innermost speaker or panel of each array may include an electrostatic speaker panel. In some embodiments all speakers or panels of each array may include electrostatic speaker panels.

A loudspeaker system as described above may provide an acceptable surround sound effect in a listening zone such as a home theatre. The system may, if cost is justified, include further radiating lobes. A polar or radiating pattern associated with the further radiating lobes may be modified and the further radiating lobes may be locatable such that their sound projection axes are directed to positions in the listening zone that are intermediate positions associated with the first and second radiating lobes or are spaced evenly between equidistant and non-equidistant listening positions. The further radiating lobes may function similarly to the first and second radiating lobes associated with each speaker array.

DESCRIPTION OF PREFERRED EMBODIMENTS

Preferred embodiments of the present invention will now be described with reference to the accompanying drawings wherein.

Figure 1:
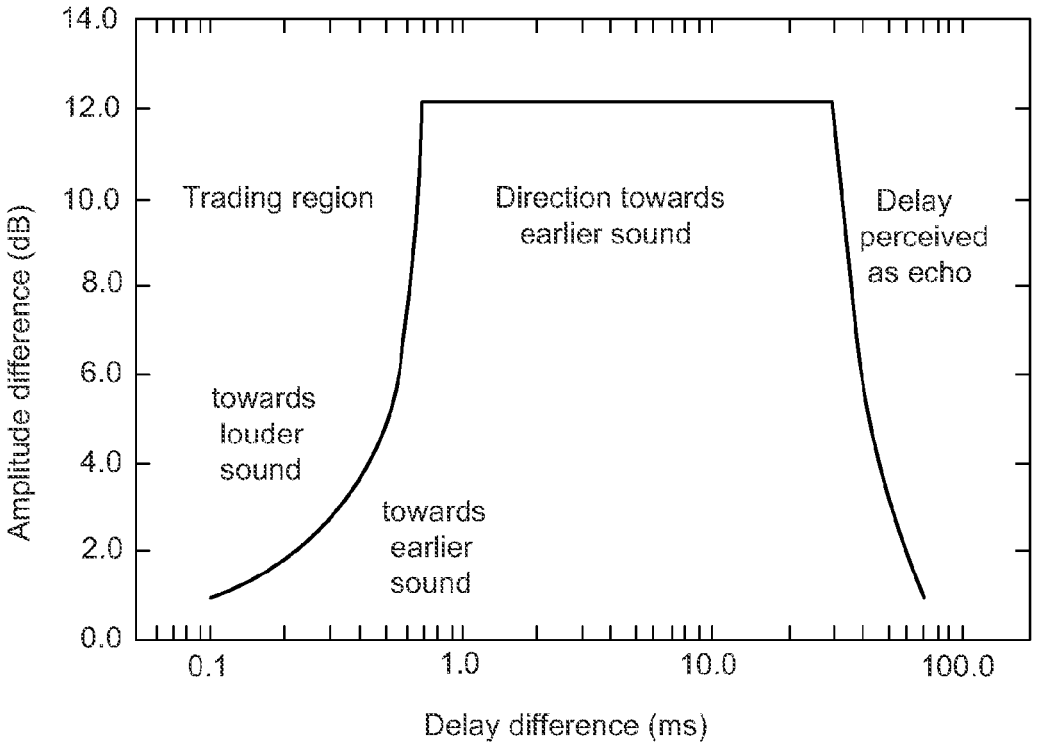
FIG. 1 shows a graph of amplitude difference (dB) versus delay difference (ms) for illustrating the HAAS or precedence effect.

Contrary to common belief, the direction from which sound arrives is perceived by the human ear based on both arrival time and loudness, not loudness alone. This is a psychoacoustic phenomenon known as the "HAAS" or "precedence" effect and is illustrated by a curve as shown in FIG. 1. For wave fronts with arrival time differences in a range 1-30 milliseconds, and sound pressure level differences of up to 12 db, arrival time is the dominant determinant of perceived sound direction. This is the region underneath the curve. Hence sound is perceived as coming from the direction of a first wave front to arrive, even if the first wave front may be up to 12 db lower in sound pressure level than a later wave front. This effect may be used to improve a stereo or simulated surround image for substantially all positions in a listening zone, by directing time corrected wave fronts at each listener. Without this time correction, only positions equidistant from left and right speakers may receive a centralised stereo or simulated surround image.

Figure 2A:
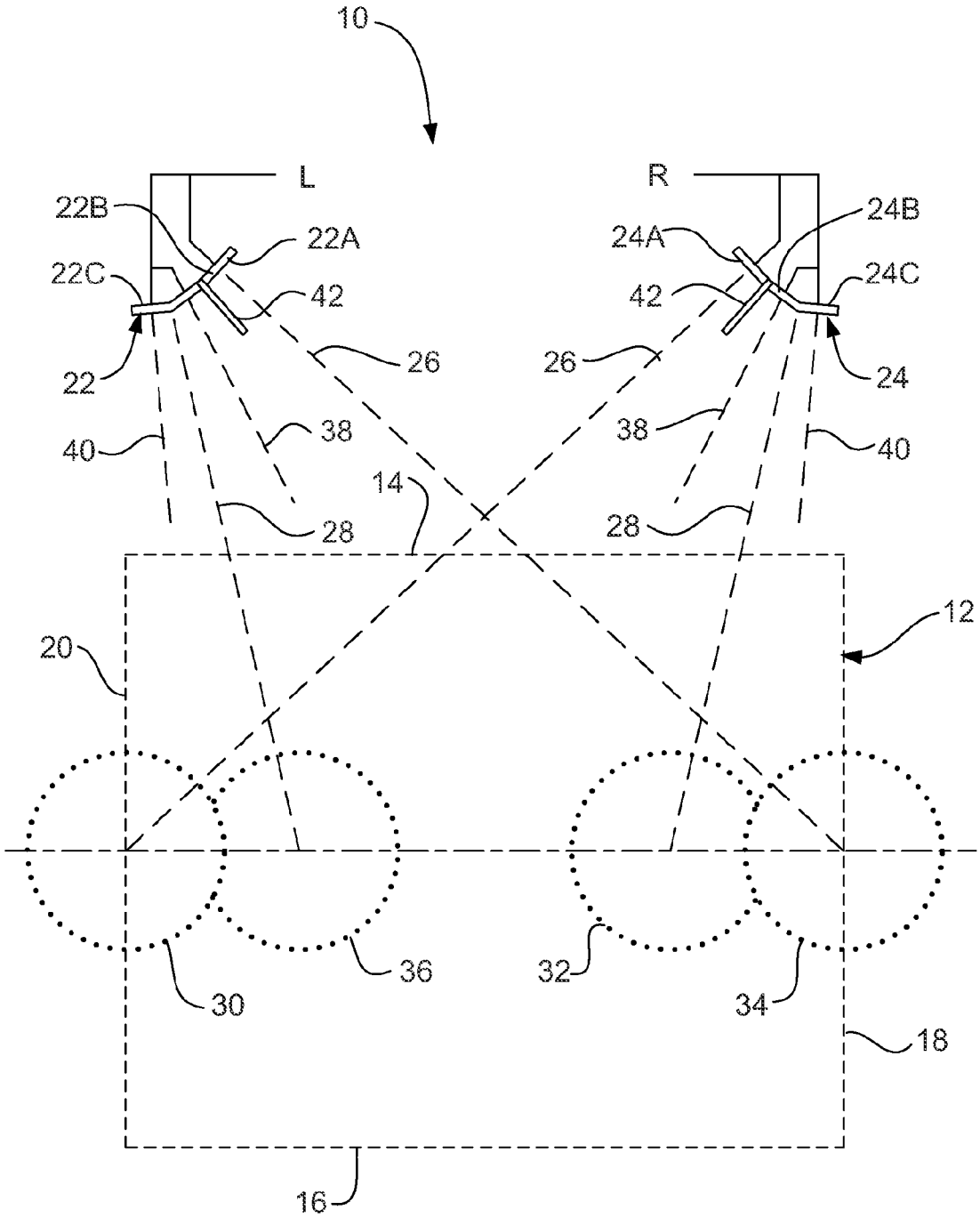
FIG. 2A shows a schematic plan view of a loudspeaker system according to one embodiment of the present invention.

With reference to FIG. 2A a loudspeaker system 10 for a listening zone 12 within a room (for example a home theatre) is shown in a plan representation as being generally quadrilateral and bounded by notional front 14 and rear 16 extremities and notional right 18 and left 20 sides. The loudspeaker system 10 includes two arrays of speakers 22, 24, with each array of speakers having discrete at least first 26 and second 28 sound radiating lobes. One array of speakers 22 is locatable at a left front position of the room whereby a line therefrom normal to the front or rear extremities 14, 16 generally defines the notional left side 20 of listening zone 12. This array is positioned such that first sound radiating lobe 26 is directed towards a position in an area 34 generally at the right side 18 of the listening zone 12 substantially midway between the front 14 and rear 16 extremities of the listening zone 12. When so positioned the speaker array 22 is arranged such that second sound radiating lobe 28 is directed towards a position in an area 36 generally about one quarter of the distance between the left 20 and right 18 sides from the left side 20 substantially midway between front 14 and rear extremity 16 of listening zone 12.

Another array of speakers 24 is locatable at a right front position of the room whereby a line therefrom normal to the front or rear extremities 14, 16 generally defines the notional right side 18 of listening zone 12. In this position first sound radiating lobe 26 of speaker array 24 is directed towards a position in an area 30 generally at the left side 20 of listening zone 12 substantially midway between front 14 and rear 16 extremities of listening zone 12. This positioning is also such that second sound radiating lobe 28 is directed towards a position in an area 32 generally about one quarter of the distance between the right 18 and left 20 sides from the right side 18 substantially midway between front 14 and rear 16 extremities of listening zone 12.

A radiating or polar pattern associated with first sound radiating lobe 26 of each speaker array is modified such that sounds projected along first sound radiating lobe 26 of the right speaker array 24 are received at a lower sound pressure level in listening zone 12 in an area defined between a line from the right speaker array 24 through a position generally about three quarters of the distance between the right 18 and left 20 sides from the right side 18 substantially midway between the front 14 and rear 16 extremities of the listening zone 12, and also such that sounds projected along first sound radiation lobe 26 of the left speaker array 22 are received at a lower sound pressure level in listening zone 12 in an area defined between a line from the left speaker array 22 through a position generally about three quarters of the distance between the right 18 and left 20 sides from the left side 20 substantially midway between the front 14 and rear 16 extremities of the listening zone 12.

Each speaker array 22, 24 may include three electrostatic panels, wherein innermost electrostatic panels 22A, 24A provide first sound radiating lobes 26 and outermost electrostatic panels 22B, 22C, 24B, 24C in combination provide second sound radiating lobes 28, wherein sound radiating lobes 28 may be regarded as a combined effect of sound radiating lobes 38, 40 (see FIG. 2A) associated with the outermost electrostatic panels 22B, 22C, 24B, 24C.

The radiation or polar pattern associated with first sound radiating lobe 26 of each speaker array 22, 24 is modified via an acoustically separating member, for example a sound separating or reflecting flap 42 which projects into the room from respective speaker arrays 22 and 24.

Figure 2B:
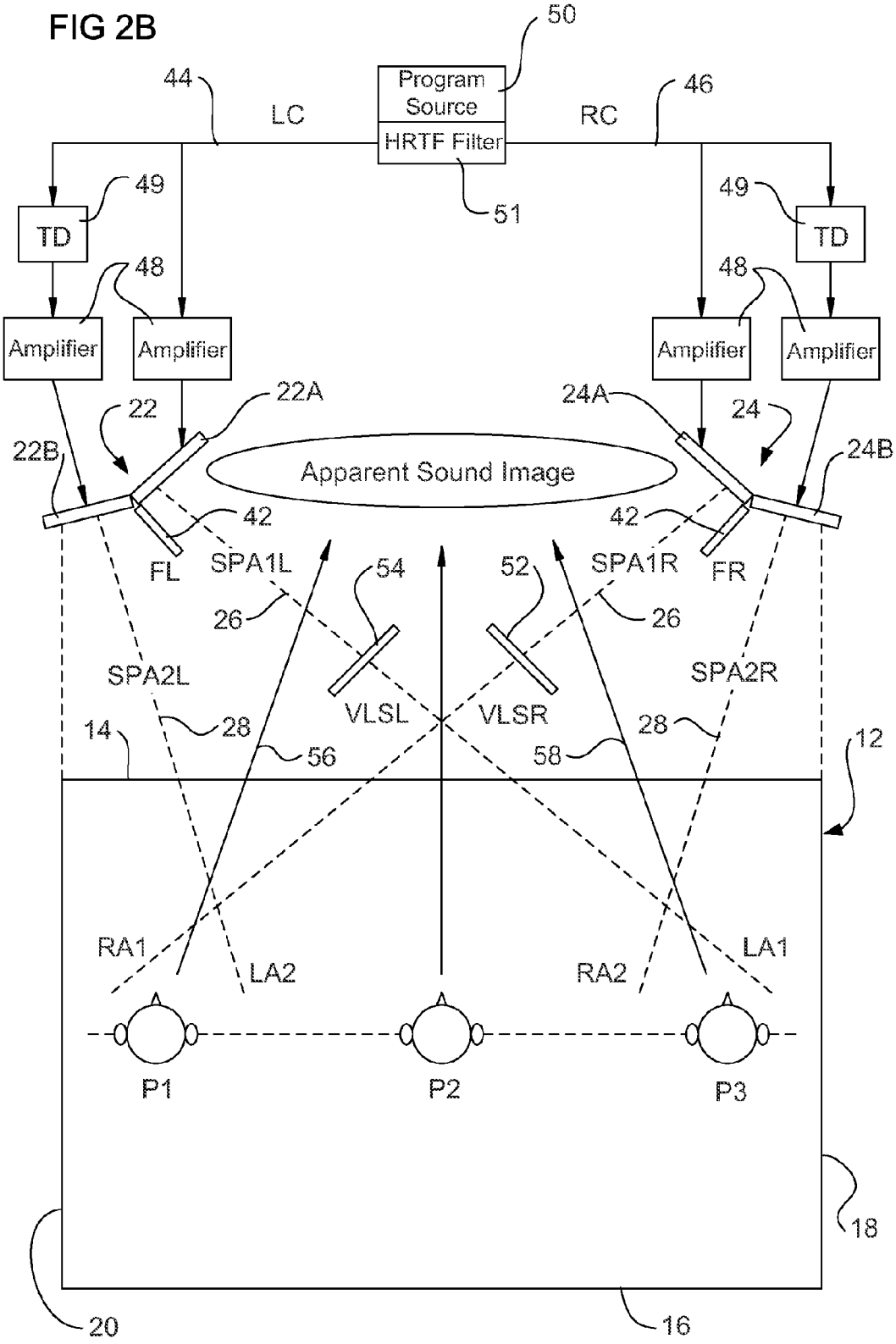
FIG. 2B shows a schematic plan view of a loudspeaker system according to an embodiment of the invention including features for providing an improved sound image in a left to right or horizontal direction of a listening zone.

FIG. 2B illustrates a further embodiment in which common reference numerals are used to indicate components and features which correspond to the embodiment in FIG. 2A.

With reference to FIG. 2B, a left speaker array (LSA) 22 and a right speaker array (RSA) 24 are located at left front and right front position of a room respectively. The room contains a listening zone 12. Example listening positions in listening zone 12 are indicated by P1, P2, and P3. For clarity, only three positions are referenced, but other listening positions may be located in the listening zone 12 either in front of, or to the rear of P1, P2, and P3. LSA 22 has first 26 and second 28 discrete sound radiation lobes SPA1L and SPA2L associated with inner speaker panel 22A and outer speaker panel 22B of the array respectively. RSA 24 has first 26 and second 28 discrete sound radiating lobes SPA1R and SPA2R associated with inner speaker panel 24A and outer speaker panel 24B of the array respectively. Left channel and right channel audio input signals LC 44 and RC 46 are amplified by amplifiers 48 and fed separately to inner and outer speaker panels of LSA 22 and RSA 24 respectively, with the signals to the outer speaker panels, 22B, 24B being delayed by time delay circuits TD 49. Left and right channels 44, 46 may be obtained from a program source 50 via HRTF filter 51.

First sound radiating lobe 26 of each speaker array is directed generally towards an area on the opposite side of listening zone 12 relative to the respective array, approximately midway between front 14 and rear 16 extremities of listening zone 12. For ease of description, these areas are referred to in FIG. 2B as LA1 which corresponds to area 34 in FIG. 2A and RA1 which corresponds to area 30 in FIG. 2A. Second sound radiating lobe 28 of each speaker array 22, 24 is directed generally towards an area located on the same side of the listening zone 12 as the respective array, at a distance from the side of the listening zone approximately equal to one quarter of the width of the listening zone, and approximately midway between front 14 and rear 16 extremities of listening zone 12. For ease of description, these areas are referred to in FIG. 2B as LA2 which corresponds to area 36 in FIG. 2A and RA2 which corresponds to area 32 in FIG. 2A.

Left speaker array 22 and right speaker array 24 are each fitted with sound separating flaps 42, FL and FR respectively, which project from the arrays into the room. The effect of the sound separating flaps is to modify the radiating or polar sound patterns associated with the first sound radiating lobes SPA1L 26 and SPA1R 26 such that generally reduced sound pressure levels are received on the "shielded" sides of the sound radiating lobes 26. The result of this modification is that sounds projected along SPA1L 26 may not affect listening positions located to the left of RA2 (refer area 32 in FIG. 2A). Similarly, sounds projected along SPA1R 26 may not affect listening positions located to the right of LA2 (refer area 36 in FIG. 2A).

A listener located in the vicinity of P2 may hear sounds projected from outer panels 22B, 24B of each speaker array centred on sound radiating lobes SPA2L 28 and SPA2R 28. For reasons outlined above, the listener may not hear sounds from inner panels 22A, 24A of each speaker array. Sounds from both outer speaker panels 22B, 24B may be time delayed by equal amounts, so the listener in the vicinity of P2 may perceive a centralised sound image by virtue of receiving sounds from left and right speaker arrays that are substantially equal in magnitude and arrival time.

A listener located in the vicinity of P1 may hear time delayed left channel sounds from the outer panel 22B of LSA 22 centred on its second sound radiation lobe SPA2L 28, and may hear right channel sounds from the inner panel 24A of RSA 24. Because sound signals from the inner panel 24A of RSA 24 are not time delayed, they may, by virtue of the HAAS effect, dominate over residual time delayed sound arriving at P1 from the outer panel of RSA 24. The relationship between the time delayed left channel sounds and the non time delayed right channel sounds may be such that the right channel sounds appear to emanate from a "virtual" right hand panel VLSR 52 located in front of inner panel 24A of RSA 24 by a distance equal to that travelled by sound in the delay time associated with time delay TD 49. The effect is that the listener P1 may perceive a sound image in a direction 56 approximately midway between the outer panel 22B of LSA 22 and virtual panel VLSR 52, such sound image appearing from the perspective of the listener to be in a substantially similar position as the sound image perceived by the listener located in the vicinity of P2. For a similar reason, a listener in the vicinity of P3 may perceive a sound image in a direction 58 approximately midway between the outer panel 24B of RSA 24 and virtual panel VLSL 54, such sound image appearing from the perspective of the listener to be in a substantially similar position as the sound image perceived by the listener located in the vicinity of P2.

An embodiment of the present invention which includes three electrostatic panels in each array as shown in FIG. 2A was tested in a listening zone about 4 meters wide and about 3 meter deep with its front extremity about 1 meter from the speaker array. The electrostatic panel of each array was about 860 mm high and 130 mm wide and the separating flap 42, which extended at 90° from the innermost electrostatic panel of each array, was about 180 mm wide.

Experiments with this embodiment indicated that there are no readily perceived transition areas in the listening zone and the perceived position of a surround sound image from the perspective of the listener is similar for listeners in substantially all positions in the listening zone. Hence an improved surround sound effect may be provided for substantially all positions throughout the listening zone.

Figure 3A:
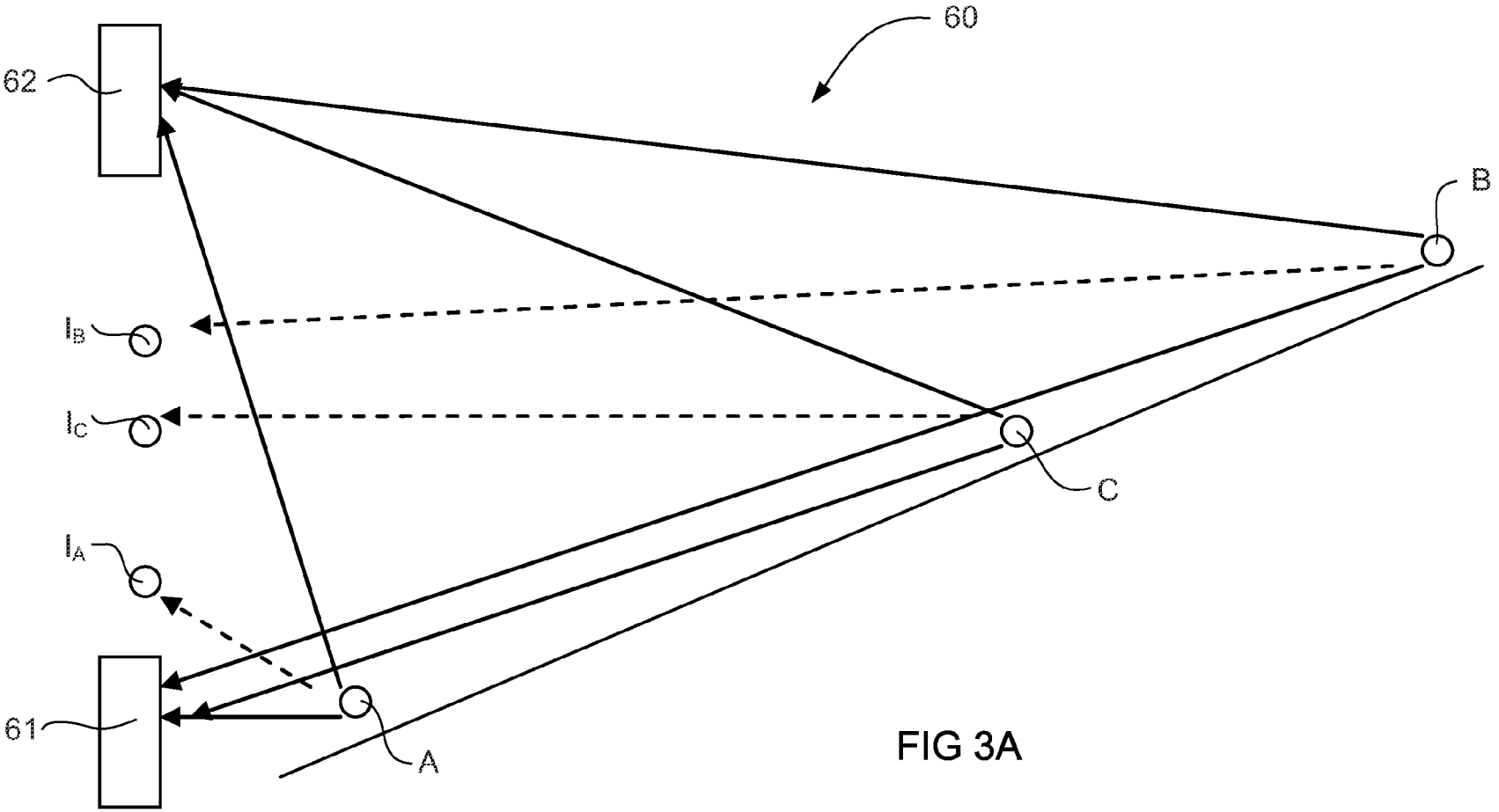
FIG. 3A shows an elevation view inside a tiered cinema auditorium including a loudspeaker system.

FIG. 3A shows a side view in a tiered cinema auditorium 60 including a front speaker cluster for location in a left front or right front position relative to the auditorium. The left speaker cluster is described below although the right speaker cluster may be substantially identical. The left speaker cluster includes a first speaker array 61 located at the front of the auditorium in a lower left position relative to a cinema screen and a second speaker array 62 located in an upper left position relative to the cinema screen.

For a listener A located near the front of the auditorium sound from lower speaker array 61 arrives before sound from upper speaker array 62 causing the apparent image of the sound to originate from a position $I_A$ closer to the bottom of the cinema screen even if array 61 produces sound pressure levels up to 12 dB lower than array 62 at the listening position.

For a listener B located near the back of the auditorium sound from upper speaker array 61 arrives before sound from lower speaker array 60 causing the apparent image of the sound to originate from a position $I_B$ shifted upwards and away from the middle of the cinema screen.

It may be seen that in a cinema auditorium as described above only a listener C located near the middle of the auditorium will experience a sound image $I_C$ that appears to originate from a position that is approximately central relative to the cinema screen. This requires sound from lower speaker array 61 to arrive substantially at the same time as sound from upper speaker array 62.

Figure 3B:
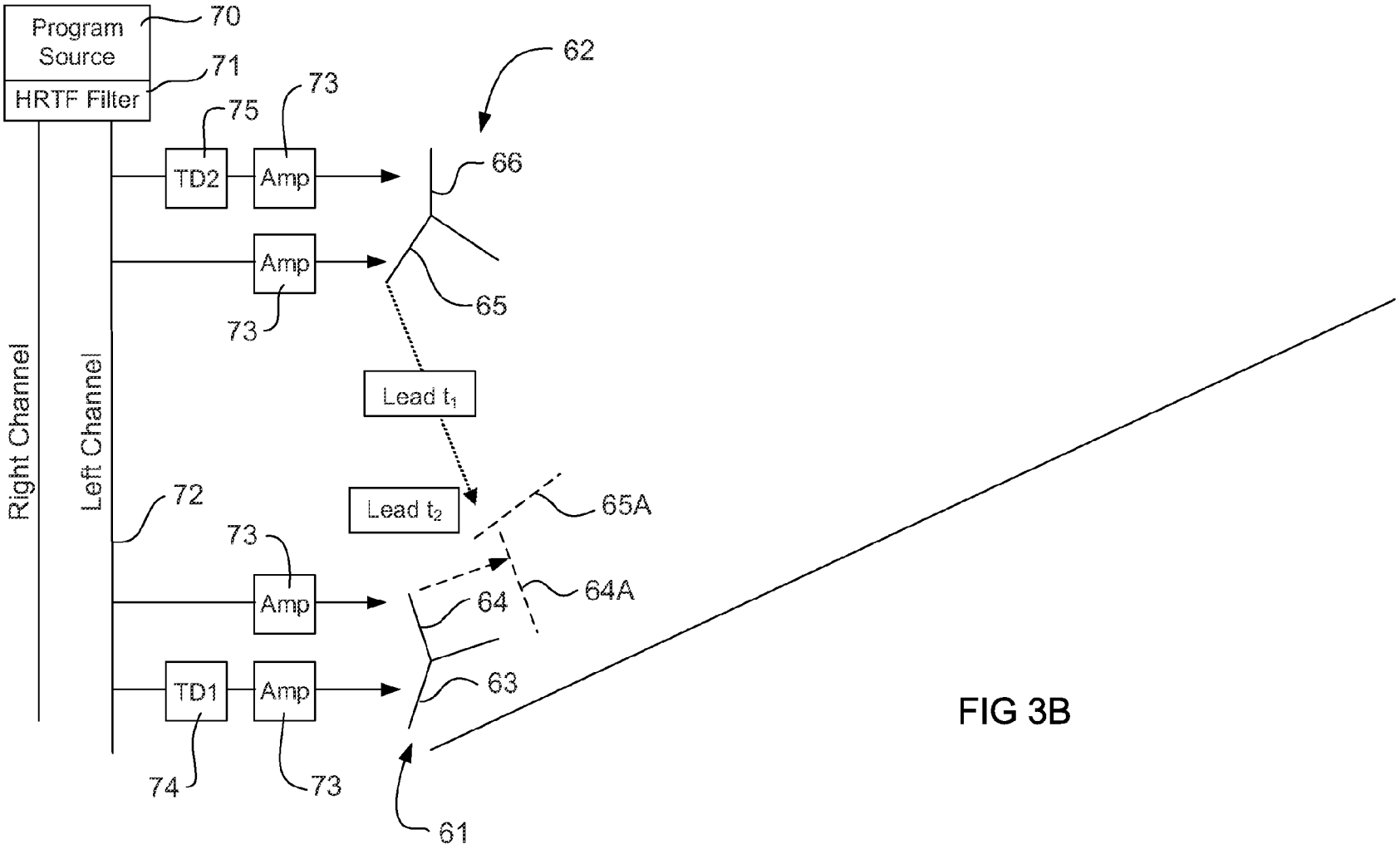
FIG. 3B shows a schematic elevation view of a loudspeaker system according to an embodiment of the invention including features for providing an improved sound image in a lower to upper or vertical direction of a listening zone.

FIG. 3B shows a side view of a loudspeaker system suitable for improving localization of a sound image for substantially all positions in a cinema auditorium of the kind shown in FIG. 3A. The description below refers to the left speaker cluster but is equally applicable to the right speaker cluster (not shown).

The left speaker cluster includes first speaker array 61 located in the lower left position relative to the cinema screen and second speaker array 62 located in the upper left position relative to the cinema screen. The first speaker array 61 includes lower and upper speaker panels 63, 64 for producing discrete first and second radiation lobes aimed towards the front and back of the auditorium respectively.

The second speaker array 62 includes lower and upper speaker panels 65, 66 for producing discrete first and second radiation lobes aimed towards the front and back of the auditorium respectively.

A program source 70 supplies a left channel audio input signal 72 via HRTF filter 71. The signal is amplified by amplifiers 73 and is separately fed to the lower and upper speaker panels 63-66. The signal to lower panel 63 of speaker array 61 is delayed by a first time delay circuit TD1 74. The signal to the upper panel 66 of speaker array 62 is delayed by a second time delay circuit TD2 75.

The radiation lobes of lower speaker panels 63, 65 are directed generally towards an area of the auditorium located approximately mid front, i.e. midway between the front and middle of the auditorium.

The radiation lobes of the upper speaker panels 64, 66 are directed generally towards an area of the auditorium located approximately mid back, i.e. midway between the middle and back of the auditorium.

For a listener located near the front of the auditorium, sound from lower speaker panel 63 of lower speaker array 61 is delayed by a time T1 associated with TD1 74 relative to sound from lower speaker panel 65 of upper speaker array 62. The time delay T1 creates a virtual speaker panel 65A located in front of speaker panel 65 by a distance equal to that travelled by sound in the delay time T1. This allows a wave front from upper speaker panel 65 to arrive to the listener at approximately the same time as a wave front from lower speaker panel 63 and generates an apparent image for the listener closer to the middle of the cinema screen.

For a listener located near the back of the auditorium, sound from upper speaker panel 66 of upper speaker array 62 is delayed by a time T2 associated with TD2 75 relative to sound from upper speaker panel 64 of lower speaker array 61. The time delay T2 creates a virtual speaker panel 64A located in front of speaker panel 64 by a distance equal to that travelled by sound in the delay time T2. This allows a wavefront from the lower speaker panel 64 to arrive to the listener at approximately the same time as a wavefront from upper speaker panel 66 and generates an apparent image for the listener closer to the middle of the cinema screen.

Due to asymmetrical placement of tiered seating relative to the centre of the cinema screen, time delay T1 may generally be smaller than time delay T2 to ensure that listeners in substantially all positions in the auditorium may experience a sound image that appears to originate from a position that is approximately central relative to the cinema screen.

Figure 4:
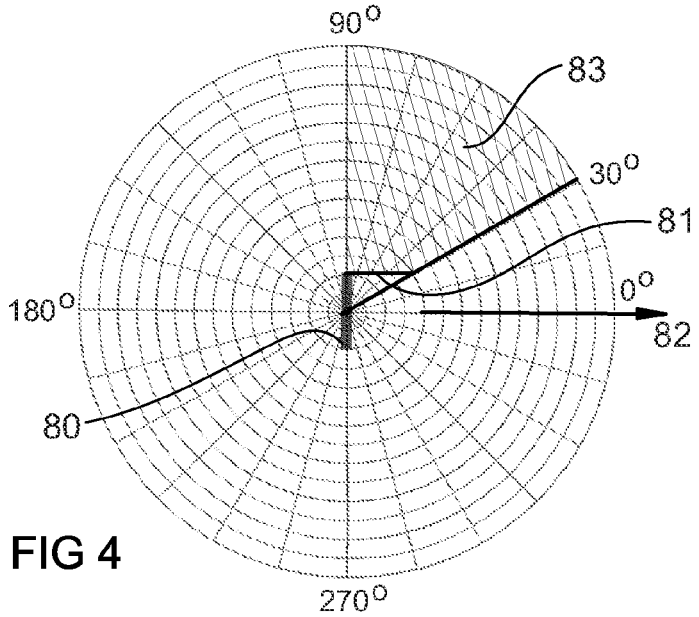
FIG. 4 is a polar diagram or plot showing a speaker panel and an acoustically opaque sound separating flap undergoing testing.

FIG. 4 shows a polar diagram or plot for a speaker panel 80 and an associated acoustically opaque sound separating flap 81 undergoing testing. Speaker panel 80 is oriented such that the main sound radiating lobe 82 associated with the speaker panel 80 lies along the 0°-180° axis of the polar diagram and the sound separating flap 81 is oriented at 90° to speaker panel 80. The diagram includes a sector 83 that extends between 30° and 90° on the polar diagram. The effect of flap 81 is to substantially shield the area denoted by sector 83 from sound projected along radiating lobe 82.

Figure 5:
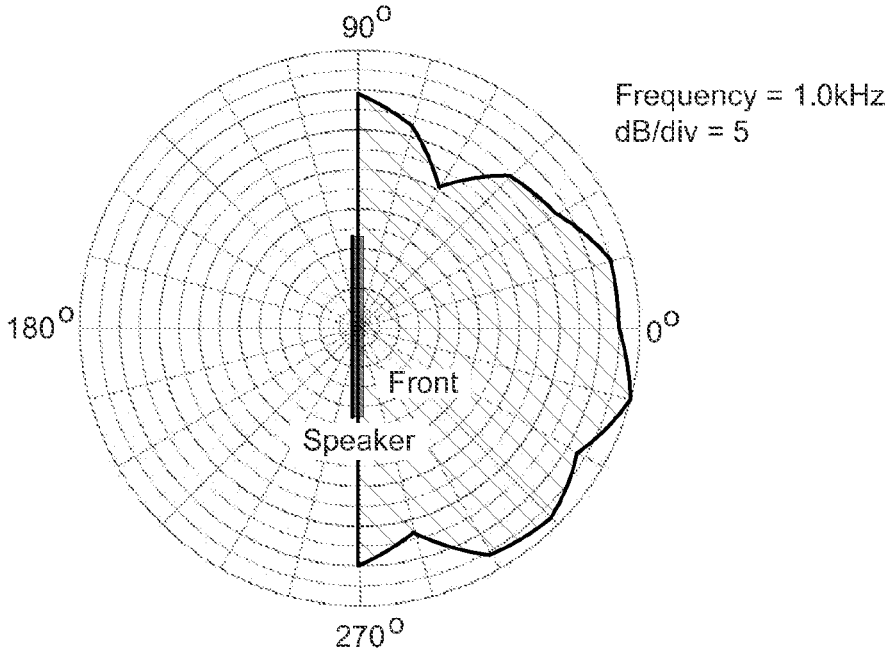
FIGS. 5 to 7 show polar diagrams or plots of sound radiating patterns for an electrostatic speaker panel with a sound separating flap measured at 1 KHz, 2 KHz and 5 KHz respectively.
Figure 6:
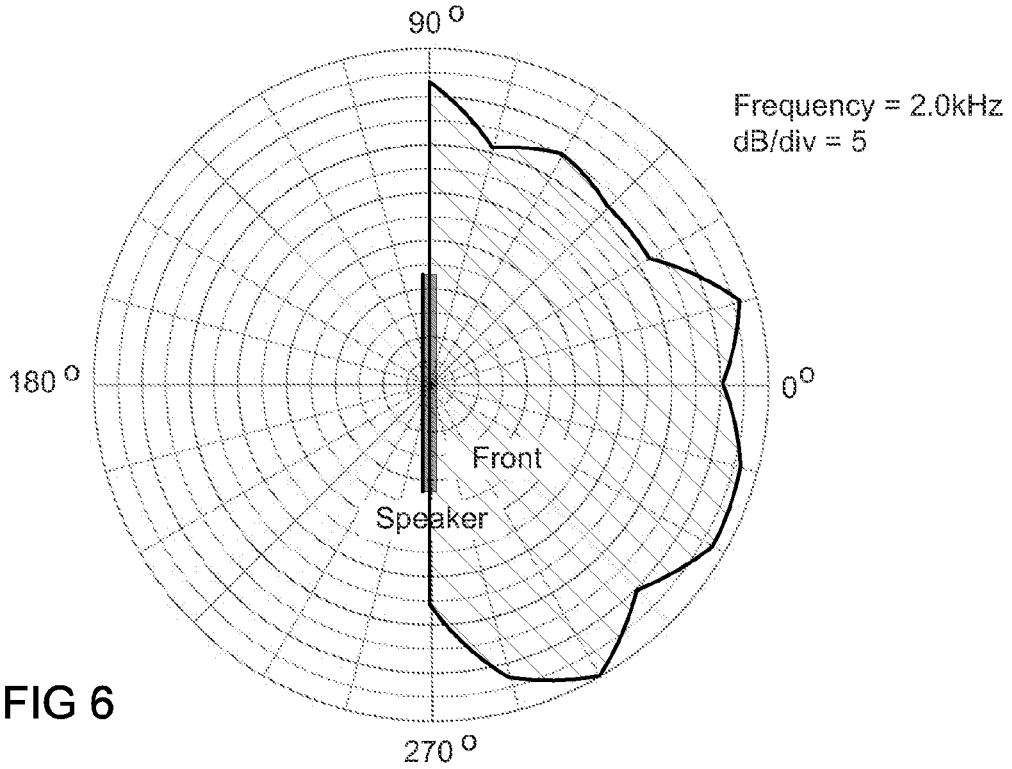
Figure 7:
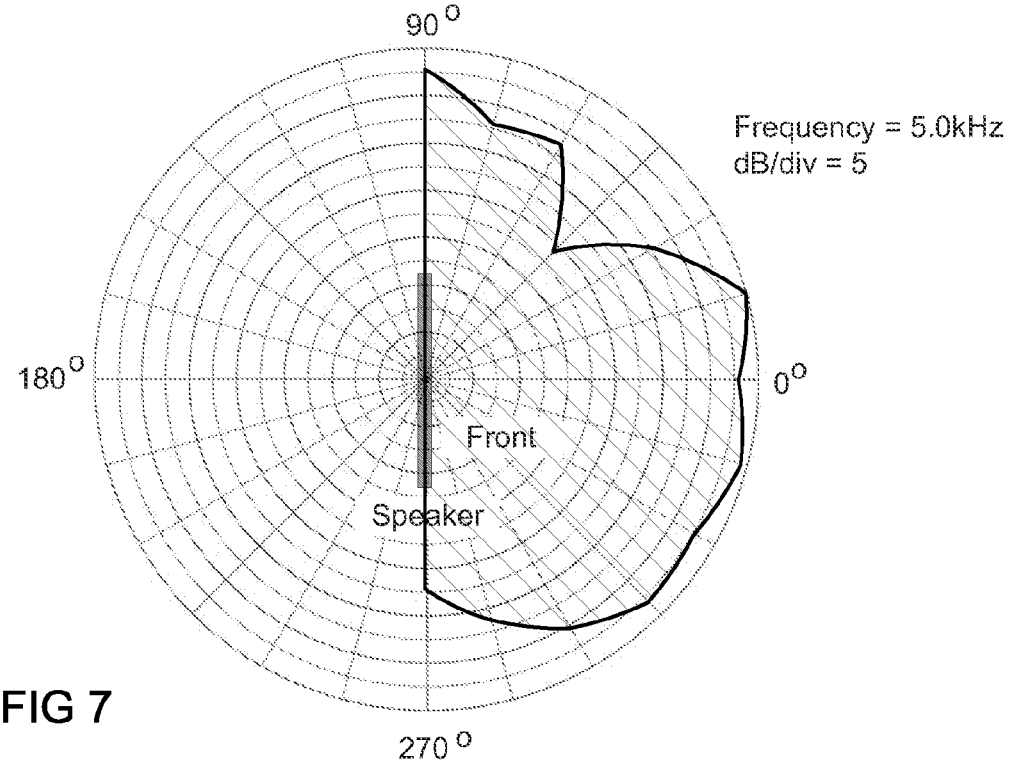

FIGS. 5 to 7 illustrate a polar diagram or plot associated with the first sound radiating lobe of each speaker array such as lobe 26 in FIG. 2B, measured at 1 KHz, 2 KHz and 5 KHz respectively with a sound separating flap shielding an area similar to sector 83 in FIG. 4. Each division on the polar diagram or plot represents 5 dB of sound level. The radiating lobe centered on the 0° axis may be representative of, for example, lobe 26 in FIG. 2B.

Figure 8:
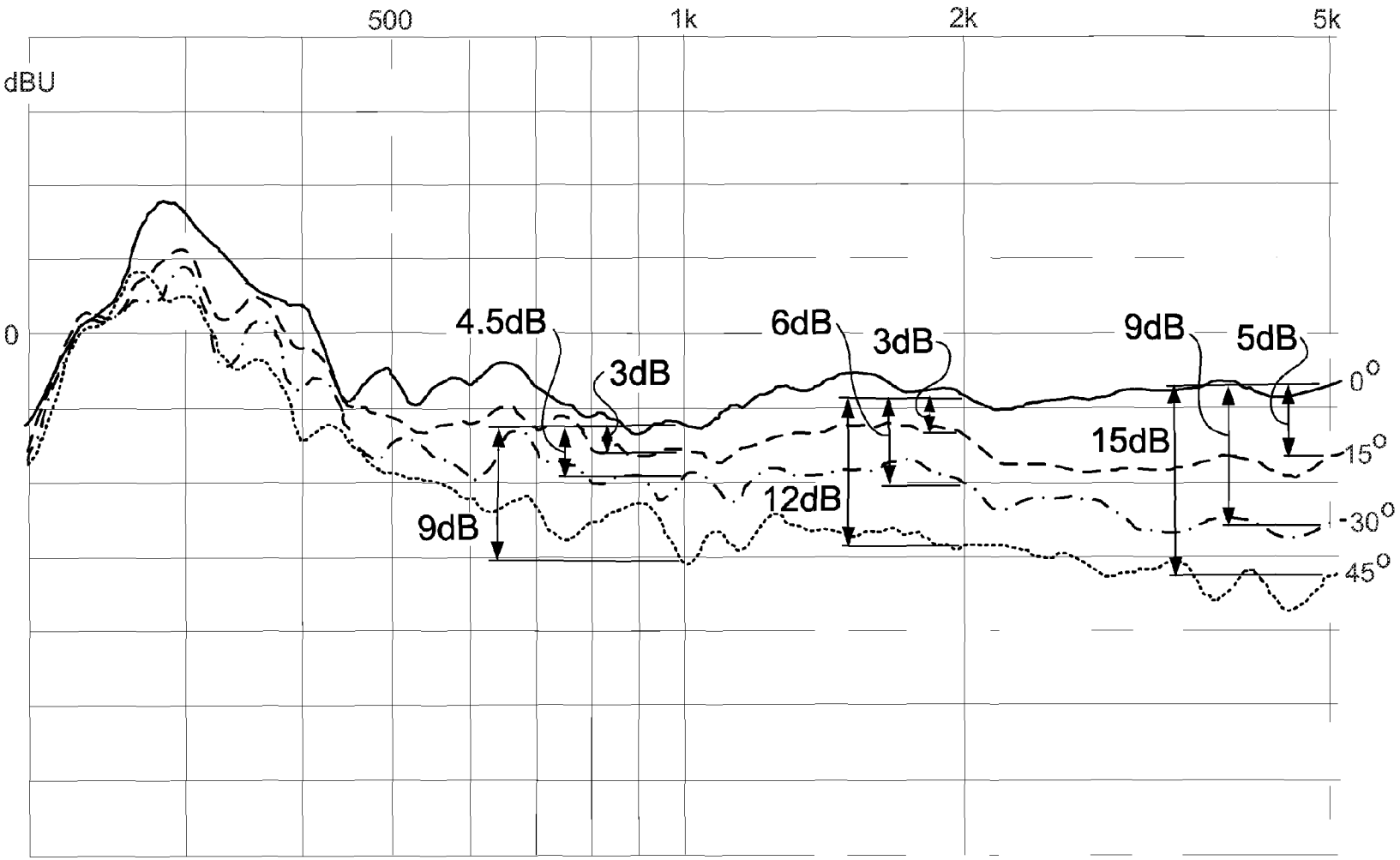
FIG. 8 shows frequency response plots for an electrostatic speaker panel fitted with an acoustically opaque sound separating flap and measured at various angles relative to the centreline of the panel.

FIG. 8 shows frequency response plots associated with sound radiating patterns for an electrostatic speaker panel fitted with a sound separating flap, such as flap 81 in FIG. 4. These plots are annotated with the differences in SPL (in dB) between the plot for 0° and the plots for 15°, 30° and 45° at frequencies of 1 kHz, 2 kHz, and 5 kHz respectively. It may be seen that at most frequencies and at most angles on a "shielded" side of a speaker panel under test, there is a modification in sound pressure levels compared to a "non-shielded" side. Similar shielding effects may be obtained with a conventional or cone speaker or array fitted with a sound separating flap, particularly when the array is configured as a line source.

A desired outcome is to reduce acoustic level above 500 Hz associated with a non-delayed speaker panel. The flap is effective above approximately 100 Hz, although the test results show peaks between 200 Hz and 400 Hz which are caused by room resonance effects and microphone placement. As may be seen from the plots in FIG. 8 the effect increases with angle. Without a sound separating flap such as flap 81 in FIG. 4, a non delayed speaker panel may dominate sound from a delayed speaker panel if it is within 10 db in level of the delayed speaker panel. The result without a sound separating flap may result in a listener not hearing the delayed sound source.

Figure 9:
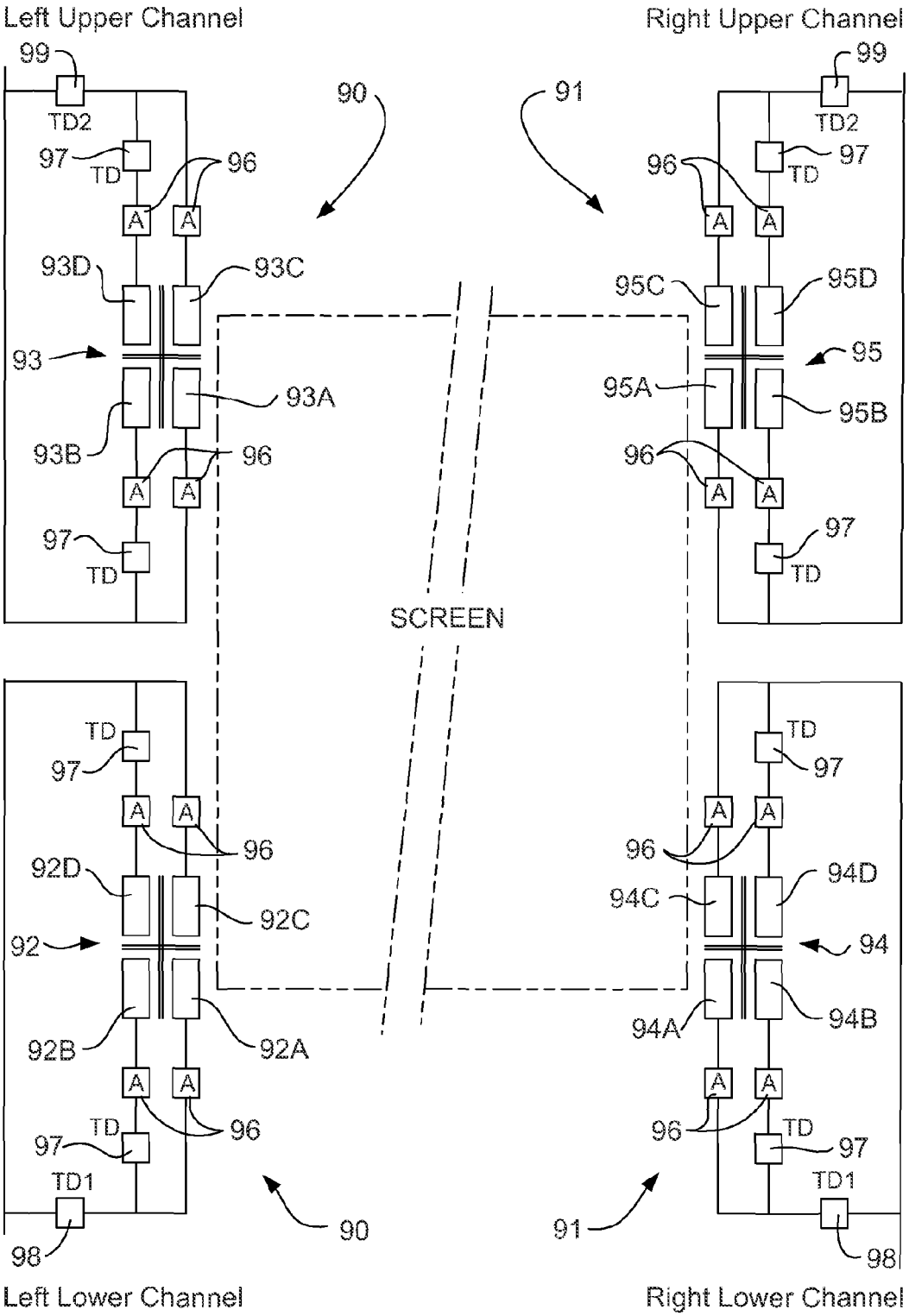
FIG. 9 shows a screen facing view of a loudspeaker system including features for providing an improved sound image in a left to right and in a lower to upper direction of a cinema auditorium.

FIG. 9 shows a screenfacing view of a loudspeaker system in a cinema auditorium including features for providing an improved sound image in a left to right (horizontal) direction of a listening zone (refer FIG. 2B) together with features for providing an improved sound image in a lower to upper (vertical) direction of the listening zone (refer FIG. 3B).

The loudspeaker system includes a left speaker cluster 90 located in a left front position relative to the auditorium and a right speaker cluster 91 located in a right front position relative to the auditorium.

Left speaker cluster 90 includes a lower speaker array 92 located in a lower left position relative to the auditorium and an upper speaker array 93 located in an upper left position relative to the auditorium.

Right speaker cluster 91 includes a lower speaker array 94 located in a lower right position relative to the auditorium and an upper speaker array 95 located in an upper right position relative to the auditorium.

Lower speaker array 92 includes lower and upper pairs of electrostatic panels 92A/92B and 92C/92D. Lower electrostatic panels 92A/92B are associated with amplifiers 96 and line delay circuit TD 97. Upper electrostatic panels 92C/92D are also associated with amplifiers 96 and time delay circuit TD 97.

Lower speaker array 94 includes lower and upper pairs of electrostatic panels 94A/94B and 94C/94D. Lower electrostatic panels 94A/94B are associated with amplifiers 96 and time delay circuit TD 97. Upper electrostatic panels 94C/94D are also associated with amplifiers 96 and time delay circuit TD 97.

Upper speaker array 93 includes lower and upper pairs of electrostatic panels 93A/93B and 93C/93D. Lower electrostatic panels 93A/93B are associated with amplifiers 96 and time delay circuit TD 97. Upper electrostatic panels 93C/93D are also associated with amplifiers 96 and time delay circuit TD 97.

Upper speaker array 95 includes lower and upper pairs of electrostatic panels 95A/95B and 95C/95D. Lower electrostatic panels 95A/95B are associated with amplifiers 96 and time delay circuit TD 97. Upper electrostatic panels 95C/95D are also associated with amplifiers 96 and time delay circuit TD 97.

The arrangement and function of electrostatic panels 92A/92B, 94A/94B and associated amplifiers 96 and time delay circuits 97 is analogous to the arrangement and function of speaker panels 22A/22B, 24A/24B, associated amplifiers 98 and time delay circuits TD 49 as described with reference to FIG. 2B.

The arrangement and function of electrostatic panels 92C/92D, 94C/94D and associated amplifiers 96 and time delay circuits 97 is also analogous to the arrangement and function of speaker panels 22A/22B, 24A/24B, associated amplifiers 48 and time delay circuits TD 49 as described with reference to FIG. 2B.

Similar comments apply to electrostatic panels 93A/93B, 95A/95B and their associated amplifiers 96 and time delay circuits 97 and electrostatic panels 93C/93D, 95C/95D and their associated amplifiers 96 and time delay circuits 97, the arrangement and function of which is also analogous to the arrangement and function of speaker panels 22A/22B, 24A/24B and associated amplifiers 48 and time delay circuits 49 as described with reference to FIG. 2B.

As described herein the arrangement and function of inner and outer speaker panels and associated amplifiers 48/96 and time delay circuits TD49/97 is to provide an improved sound image in a left to right (horizontal) direction of the listening zone/auditorium.

Electrostatic panels 92A/92B are further associated with time delay circuit TD1 98 and electrostatic panels 93C/93D are further associated with time delay circuit TD2 99. Similarly electrostatic panels 94A/94B and 95C/95D are further associated with time delay circuits TD1 98 and TD2 99.

The arrangement and function of electrostatic panels 92A/92C, 93A/93C and associated amplifiers 96 and time delay circuits TD1 98 and TD2 99 is analogous to the arrangement and function of speaker panels 63/64, 65/66 and associated amplifiers 73 and time delay circuits TD1 74 and TD2 75 as described with reference to FIG. 3B.

The arrangement and function of electrostatic panels 92B/92D, 93B/93D and associated amplifiers 96 and time delay circuits TD1 98 and TD2 99 is also analogous to the arrangement and function of speaker panels 63/64, 65/66 and associated amplifiers 73 and time delay circuits TD1 74 and TD2 75 as described with reference to FIG. 3B.

Similar comments apply to electrostatic panels 94A/94C, 95A/95C and their associated amplifiers 97 and time delay circuits TD1 98 and TD2 99 and electrostatic panels 94B/94D, 95B/95D and their associated amplifiers 97 and time delay circuits TD1 98 and TD2 99, the arrangement and function of which is also analogous to the arrangement and function of speaker panels 63/64, 65/66 and associated amplifiers 73 and time delay circuits TD1 74 and TD2 75 as described with reference to FIG. 3B.

As described herein the arrangement and function of upper and lower speaker panels and associated amplifiers 73/96 and time delay circuits TD1 74/98 and TD2 75/99 is to provide an improved sound image in a lower to upper (vertical) direction of the listening zone/auditorium.

The arrangement of speaker clusters shown in FIG. 9 is suitable for a sound source that provides discrete top and bottom left and right channels of sound. The clusters are also suitable for a sound source that provides discrete left and right channels of sound only. In the latter case the left upper and lower arrays 92,93 may be connected in parallel to the left sound source and the right upper and lower arrays 94.95 may be connected in parallel to the right sound source.

The invention described herein is susceptible to variations, modifications and/or additions other than those specifically described and it is to be understood that the invention includes all such variations, modifications and/or additions which fall within the spirit and scope of the above description.

For example, it may be appreciated that a loudspeaker system as described herein may be applied to any number of pairs of loudspeakers (2n channels in general) to improve localization of a sound image associated with each respective pair of loudspeakers. For example the system described herein may be applied to an installation including two front and two rear speaker arrays or clusters including 4 channels, 5.1 channels etc., wherein localization of a sound image associated with the rear pair of speaker arrays or clusters may be improved in a manner similar to the front pair of speaker arrays or clusters. In some embodiments the loudspeaker system may be applied to four pairs of speaker arrays arranged at respective corners of a cube or a rectangular cuboid to define upper and lower planes of four speakers each, namely four speakers in the front and four speakers in the back. The upper plane of speakers may be vertically separated relative to the lower plane of speakers by approximately 2-3 m or other suitable distance depending on usable height in the listening zone or auditorium.

The invention claimed is:

1. A loudspeaker system for reproducing multichannel sound with an improved sound image in a listening zone, said loudspeaker system including:

a first speaker array for location in a first position relative to said listening zone;

a second speaker array for location in a second position relative to said listening zone;

said first speaker array including a first radiating lobe for radiating first sound of said multichannel sound and at least a second radiating lobe for radiating a delayed version of said first sound;

a first sound separating member which projects into said listening zone, for separating said first radiating lobe associated with said first sound of said multichannel sound from said second radiating lobe associated with said delayed version of said first sound;

said second speaker array including a first radiating lobe for radiating second sound of said multichannel sound, and at least a second radiating lobe for radiating a delayed version of said second sound; and a second sound separating member which projects into said listening zone, for separating said first radiating lobe associated with said second sound of said multichannel sound from said second radiating lobe associated with said delayed version of said second sound;

wherein said first and second radiating lobes and said sound separating members are arranged to cooperate such that a listening position substantially equidistant from said first and second arrays is exposed to radiation from said second lobes or from said first lobes and a listening position not substantially equidistant from said first and second arrays is exposed to radiation from both said first lobe of one array and said second lobe of the other array such that substantially all positions in said listening zone receive sound radiation from said first and second arrays with substantially equal arrival times.

2. A loudspeaker system according to claim 1 wherein said first speaker array is located in a left front position relative to said listening zone and said second speaker array is located in a right front position relative to said listening zone.

3. A loudspeaker system according to claim 1 wherein said first speaker array is located in a lower left position relative to said listening zone and said second speaker array is located in an upper left position relative to said listening zone.

4. A loudspeaker system according to claim 1 wherein said first speaker array is located in a lower right position relative to said listening zone and said second speaker array is located in an upper right position relative to said listening zone.

5. A loudspeaker system according to claim 1 wherein said simulated surround sound includes sound reproduced via a head related transfer function (HRTF) filter.

6. A loudspeaker system according to claim 1 wherein said first speaker array includes a third radiating lobe for radiating a further delayed version of said first sound and said second speaker array includes a third radiating lobe for radiating a further delayed version of said second sound.

7. A loudspeaker system according to claim 1 wherein said first and said second sound separating member includes at least one sound reflecting member.

8. A loudspeaker system according to claim 7 wherein said first and said second sound separating member includes a flap which projects into said listening zone.

9. A loudspeaker system according to claim 1 wherein said first and said second sound separating member is provided by shaping an enclosure associated with each speaker array.

10. A loudspeaker system according to claim 1 including adjusting means for adjusting sound pressure level associated with each radiating lobe.

11. A loudspeaker system as claimed in claim 1 wherein each array of speakers include at least two speaker panels, one of which provides the first sound radiating lobe and the other of which provides the second sound radiating lobe.

12. A loudspeaker system as claimed in claim 11 wherein the speaker panels of each array include a relatively narrow radiating or polar pattern at mid to high range frequencies.

13. A loudspeaker system as claimed in claim 11 wherein the innermost speaker panel of each array includes an electrostatic speaker panel.

14. A loudspeaker system as claimed in claim 11 wherein all speaker panels of each array include electrostatic speaker panels.

15. A loudspeaker system as claimed in claim 1 wherein each array of speakers includes three speaker panels, wherein an innermost speaker panel of each array provides the first sound radiating lobe and the two outermost speaker panels of each array provide in combination the second sound radiating lobe.

16. A loudspeaker system according to claim 1 wherein for a not equidistant listening position said time delay (Td) is obtained by the expression Td=(Dn−Df) I v, wherein Dn is the distance from the not equidistant listening position to a nearer speaker array and Df is the distance from the non equidistant listening position to a further speaker array and v is the speed of sound.

17. A loudspeaker system as claimed in claim 1 including two further speaker arrays, each further array having discrete first and second sound radiating lobes, wherein one said further speaker array is locatable at a right rear position of the listening zone and the other said further speaker array is locatable at a left rear position of the listening zone, wherein each further speaker array includes a respective sound separating member for separating respective first and second sound radiating lobes associated with the further speaker arrays, and wherein the further speaker arrays are locatable at the rear of the listening zone such that their sound radiating lobes are directed into the listening zone and the radiating lobes and separating members associated with the further speaker arrays function similarly mutatis mutandis, to the radiating lobes and separating members associated with the front speaker arrays.

18. A loudspeaker array for a loudspeaker system as claimed in claim 1 including two speaker panels arranged side by side such that one speaker panel provides the first sound radiating lobe and the other speaker panel provides the second sound radiating lobe.

19. A loudspeaker array as claimed in claim 18 including three speaker panels arranged side by side, wherein an innermost speaker panel of each array provides the first sound radiating lobe and the two outermost speaker panels of each array in combination provide the second sound radiating lobe.

20. A loudspeaker array as claimed in claim 18 wherein each sound separating member is acoustically opaque.

21. A loudspeaker array as claimed in claim 20 wherein each acoustically opaque member includes a sound separating flap which projects into the listening zone from the array.

22. A loudspeaker array as claimed in claim 18 wherein the first sound separating member is provided by shaping an enclosure associated with each speaker panel.

23. A loudspeaker array as claimed in claim 18 wherein each speaker panel includes a relatively narrow radiating or polar pattern at mid to high frequencies.

24. A loudspeaker array as claimed in claim 18 wherein the innermost speaker panel of each array includes an electrostatic speaker panel.

25. A loudspeaker array as claimed in claim 18 wherein all speaker panels of the array include electrostatic speaker panels.

26. A loudspeaker array as claimed in claim 18 including amplifiers associated with speaker panels of the array and a signal delay circuit for speaker panels associated with the second sound radiating lobe to provide a delay in sound transmission associated with that lobe.

27. A loudspeaker system for a listening zone in a room such as a home theatre, the listening zone including notional front and rear extremities and notional right and left sides in a plan representation, the loudspeaker system including:

first and second arrays of speakers, each array of speakers including discrete at least first and second sound radiating lobes;

wherein the first array of speakers is locatable at a left front position of the room whereby a line therefrom normal to the front or rear extremities generally defines the notional left side of the listening zone, such that the first sound radiating lobe of the first speaker array is directed towards a position within an area generally at the right side of the listening zone substantially midway between the front and rear extremities of the listening zone, and such that the second sound radiating lobe is directed towards a position within an area generally about one quarter of the distance between the right and left sides from the left side substantially midway between the front and rear extremities of the listening zone;

wherein the second array of speakers is locatable at a right front position of the room whereby a line therefrom normal to the front or rear extremities generally defines the notional right side of the listening zone such that the first sound radiating lobe of the second speaker array is directed towards a position within an area generally at the left side of the listening zone substantially midway between the front and rear extremities of the listening zone, and such that the second sound radiating lobe of the speaker array is directed towards a position within an area generally about one quarter of the distance between the right and left sides from the right side substantially midway between the front and rear extremities of the listening zone;

wherein a radiating or polar pattern associated with the first sound radiating lobe of the first speaker array is modified such that it is received at a lower sound pressure level in the listening zone in an area defined between a line from the first speaker array through a position generally about three quarters of the distance between the right and left sides from the right side substantially midway between the front and rear extremities of the listening zone and the right side of the listening zone, and wherein a radiating or polar pattern associated with the first radiating lobe of the second speaker array is modified such that it is received at a lower sound pressure level in the listening zone in an area defined between a line from the second speaker array through a position generally about three quarters of the distance between the left and right sides from the left side substantially midway between the front and rear extremities of the listening zone and the left side of the listening zone.

28. A loudspeaker system as claimed in claim 27 wherein each speaker array includes modifying means for modifying the radiating or polar pattern associated with the first sound radiating lobe.

29. A loudspeaker system as claimed in claim 27 wherein each speaker array is associated with amplifiers and time delay circuits, wherein the amplifiers are adjustable to provide gains such that sound pressure levels of sounds reaching a listener at any position in the listening zone from a first speaker array are substantially equal to sound pressure levels of sounds reaching the same listener from the second speaker array, and wherein the time delay circuits associated with each array are adjustable to provide sound transmitted along at least one radiating lobe of an array that is time delayed relative to sound transmitted along at least one other radiating lobe of that array, such that coincident sounds directed towards the listener at said any position in the listening zone from the first and second arrays of speakers will reach said listener with substantially equal arrival times.

30. A loudspeaker system as claimed in claim 29 wherein the second radiating lobe of each array is associated with a signal delay circuit to provide a delay in sound transmission relative to the first radiating lobe of each array.

31. A loudspeaker system as claimed in claim 27 including two further speaker arrays, each further array having discrete first and second sound radiating lobes, wherein one said further speaker array is locatable at a right rear position of the listening zone and the other said further speaker array is locatable at a left rear position of the listening zone, wherein a radiating or polar pattern associated with the first sound radiating lobe of each further speaker array is modified, and wherein the further speaker arrays are locatable at the rear of the listening zone such that their sound radiating lobes are directed into the listening zone and the modified radiating or polar patterns function similarly mutatis mutandis, to the front speaker arrays.

32. A loudspeaker array for a loudspeaker system as claimed in claim 27 including two speaker panels arranged side by side such that one speaker panel provides the first sound radiating lobe and the other speaker panel provides the second sound radiating lobe.

33. A loudspeaker array as claimed in claim 32 including three speaker panels arranged side by side, wherein an innermost speaker panel of each array provides the first sound radiating lobe and the two outermost speaker panels of each array in combination provide the second sound radiating lobe.

34. A loudspeaker array as claimed in claim 32 including modifying means for modifying the radiating or polar pattern associated with the first sound radiating lobe.

35. A loudspeaker array as claimed in claim 34 wherein said modifying means for modifying the radiating or polar pattern include an acoustically opaque member.

36. A loudspeaker array as claimed in claim 35 wherein the acoustically opaque member includes a sound separating flap which projects into the listing zone from the array.

37. A loudspeaker array as claimed in claim 32 wherein the radiating or polar pattern associated with the first sound radiating lobe is modified by shaping an enclosure associated with each speaker panel.

38. A loudspeaker array as claimed in claim 32 wherein each speaker panel includes a relatively narrow radiating or polar pattern at mid to high frequencies.

39. A loudspeaker array as claimed in claim 32 wherein the innermost speaker panel of each array includes an electrostatic speaker panel.

40. A loudspeaker array as claimed in claim 32 wherein all speaker panels of the array include electrostatic speaker panels.

41. A loudspeaker array as claimed in claim 31 including amplifiers associated with speaker panels of the array and a signal delay circuit for speaker panels associated with the second sound radiating lobe to provide a delay in sound transmission associated with that lobe.

42. A loudspeaker system for reproducing multichannel sound with an improved sound image in a listening zone, said loudspeaker system including:

a left speaker cluster for location in a left front position relative to said listening zone, said left speaker cluster including a first speaker array located in a lower left position relative to said listening zone and a second speaker array located in an upper left position relative to said listening zone;

a right speaker cluster for location in a right front position relative to said listening zone, said right speaker cluster including a third speaker array located in a lower right position relative to said listening zone and a fourth speaker array located in an upper right position relative to said listening zone;

each left speaker array including a first radiation lobe for radiating first sound of said multichannel sound and at least a second radiation lobe for radiating a delayed version of said first sound;

each right speaker array including a first radiation lobe for radiating second sound of said multichannel sound, and at least a second radiation lobe for radiating a delayed version of said second sound; and wherein each speaker array includes a respective sound separating member which projects into said listening zone for separating each first radiating lobe from each second radiating lobe;

wherein said first and second radiating lobes and said sound separating members are arranged to cooperate such that a listening position substantially equidistant from said left and right clusters is exposed to sound radiation from delayed radiation lobes or from non-delayed radiation lobes associated with said left or right clusters and a listening position not substantially equidistant from said left and right clusters is exposed to sound radiation from both delayed and non delayed radiation lobes associated with said left or right clusters, and a listening position substantially equidistant from said lower and upper speaker arrays is exposed to sound radiation from delayed radiation lobes or non delayed radiation lobes associated with said upper or lower arrays and a listening position not substantially equidistant from said lower and upper speaker arrays is exposed to sound radiation from both delayed and non delayed radiation lobes associated with said upper and lower arrays such that substantially all positions in said listening zone receive sound radiation from said arrays with substantially equal arrival times.

* * * * *